US007976085B1

(12) United States Patent
Neaton

(10) Patent No.: US 7,976,085 B1
(45) Date of Patent: Jul. 12, 2011

(54) LIFT MEMBER—SAFETY LATCH COMBINATION

(76) Inventor: Michael Neaton, Watertown, MN (US)

( * ) Notice: Subject to any disclaimer, the term of this patent is extended or adjusted under 35 U.S.C. 154(b) by 183 days.

(21) Appl. No.: 12/366,325

(22) Filed: Feb. 5, 2009

Related U.S. Application Data

(60) Provisional application No. 61/026,354, filed on Feb. 5, 2008.

(51) Int. Cl.
*B66C 13/06* (2006.01)
*B66C 1/10* (2006.01)

(52) U.S. Cl. ..... 294/67.22; 294/103.1

(58) Field of Classification Search ..... 294/67.22, 294/67.2, 67.21, 67.3, 103.1; 414/798.9
See application file for complete search history.

(56) References Cited

U.S. PATENT DOCUMENTS

| | | | | |
|---|---|---|---|---|
| 1,272,359 | A * | 7/1918 | Bell | 294/103.1 |
| 1,621,650 | A * | 3/1927 | Angel | 294/67.22 |
| 2,666,664 | A | 1/1954 | Johnson | |
| 3,053,344 | A | 9/1962 | Buck | |
| 3,056,624 | A | 10/1962 | Nardone | |
| 3,311,401 | A | 3/1967 | Bacon | |
| 3,581,840 | A | 6/1971 | Hirst, Jr. et al. | |
| 3,671,015 | A * | 6/1972 | Sullivan | 254/332 |
| 3,964,777 | A | 6/1976 | Lindqvist | |
| 4,000,923 | A * | 1/1977 | Baldwin | 294/81.5 |
| 4,077,661 | A | 3/1978 | Inahashi | |
| 4,181,341 | A * | 1/1980 | Henke | 294/67.22 |
| 4,266,816 | A | 5/1981 | Mukai et al. | |
| 4,302,041 | A * | 11/1981 | Kreitler | 294/67.22 |
| 4,379,579 | A | 4/1983 | Mahan et al. | |
| 4,489,970 | A * | 12/1984 | Henke | 294/67.22 |
| 4,530,535 | A | 7/1985 | Hargreaves | |
| 4,609,219 | A | 9/1986 | Go | |
| 4,691,584 | A | 9/1987 | Takaishi et al. | |
| 4,767,144 | A | 8/1988 | Hornberg | |
| 5,181,403 | A | 1/1993 | Lii | |
| 5,636,888 | A | 6/1997 | Kiser et al. | |
| 5,673,575 | A | 10/1997 | Carlo et al. | |
| 5,704,668 | A | 1/1998 | Ferrato | |
| 6,036,248 | A | 3/2000 | Fanger et al. | |
| 6,375,242 | B1 | 4/2002 | Zingerman | |
| 2004/0217610 | A1 * | 11/2004 | Hollman et al. | 294/67.22 |
| 2005/0127695 | A1 | 6/2005 | Cranston et al. | |

FOREIGN PATENT DOCUMENTS

EP 0 630 784 A1 12/1994

* cited by examiner

*Primary Examiner* — Paul T Chin
(74) *Attorney, Agent, or Firm* — Fellers, Snider, et al.; Daniel P. Dooley

(57) ABSTRACT

A lift member safety latch combination is disclosed. The lift member safety latch combination has a lift member that supports a drive mechanism and an actuator that is positioned adjacent to the drive mechanism. The lift member safety latch combination also has a confinement member that is in sliding communication with the lift member. The confinement member's position is responsive to the drive mechanism and has a state that is responsive to the actuator.

18 Claims, 6 Drawing Sheets

LIFT MEMBER—SAFETY LATCH COMBINATION

RELATED APPLICATIONS

This application claims domestic priority to U.S. Provisional Application No. 61/026,354 filed Feb. 5, 2008, entitled "Lift Member—Safety Latch Combination."

FIELD OF THE INVENTION

The claimed invention relates to the field of load fastening devices and more particularly to remote controlled load support and accidental release prevention devices for cranes.

BACKGROUND

The ability to effectively rig, hoist, position, and release prestaged loads remotely has been a continual goal of the construction industry.

Historically, loads being prepared for hoisting required manual rigging to properly and safely secure the load. For example, crane cables would need to be manually positioned and attached to a load with fastening equipment. The need for multiple people and various pieces of equipment limits the efficiency and safety of hoisting a load. Many attempts have been made to remotely rig and hoist a load including U.S. Pat. Nos. 6,036,248 and 6,375,242. However, the attempts have resulted in complicated and inefficient devices that are applicable to a limited number of applications.

Likewise, devices have been disclosed that are capable of remotely rigging and hoisting a load with a specific attachment point such as an eyelet. The constant variety of hoisting needs in the construction industry demands a device that is capable of handling variously shaped loads with or without specific attachment points. Another common issue encountered through the use of past inventions is the bulky size and required movement to fasten and release a load. Such bulky size and movement limits the devices' ability to effectively provide lifting force on loads with difficult to access points.

Accordingly, there is a continuing need for improved devices that remotely rig and hoist a load in a safe and efficient manner.

SUMMARY OF THE INVENTION

In accordance with preferred embodiments, the lift member safety latch combination has a lift member that supports a drive mechanism and an actuator that is positioned adjacent to the drive mechanism. The lift member safety latch combination also has a confinement member in sliding communication with the lift member. The confinement member's position is responsive to the drive mechanism and has a state that is responsive to the actuator.

In an alternate preferred embodiment, a method of using a lift member safety latch combination involves at least the steps of providing a lift member that supports a drive mechanism and an actuator positioned adjacent to the drive mechanism and has a confinement member in sliding communication with the lift member, position responsive to the drive mechanism, and a state that is responsive to the actuator. Finally, a retention region of the lift member is enclosed by the confinement member.

These and various other features and advantages that characterize the claimed invention will be apparent upon reading the following detailed description and upon review of the associated drawings.

DETAILED DESCRIPTION OF THE PREFERRED EMBODIMENT OF THE DRAWINGS

Reference will now be made in detail to one or more examples of the invention depicted in the figures. Each example is provided by way of explanation of the invention, and not meant as a limitation of the invention. For example, features illustrated or described as part of one embodiment may be used with another embodiment to yield still a different embodiment. Other modifications and variations to the described embodiments are also contemplated within the scope and spirit of the invention.

Figure 1:
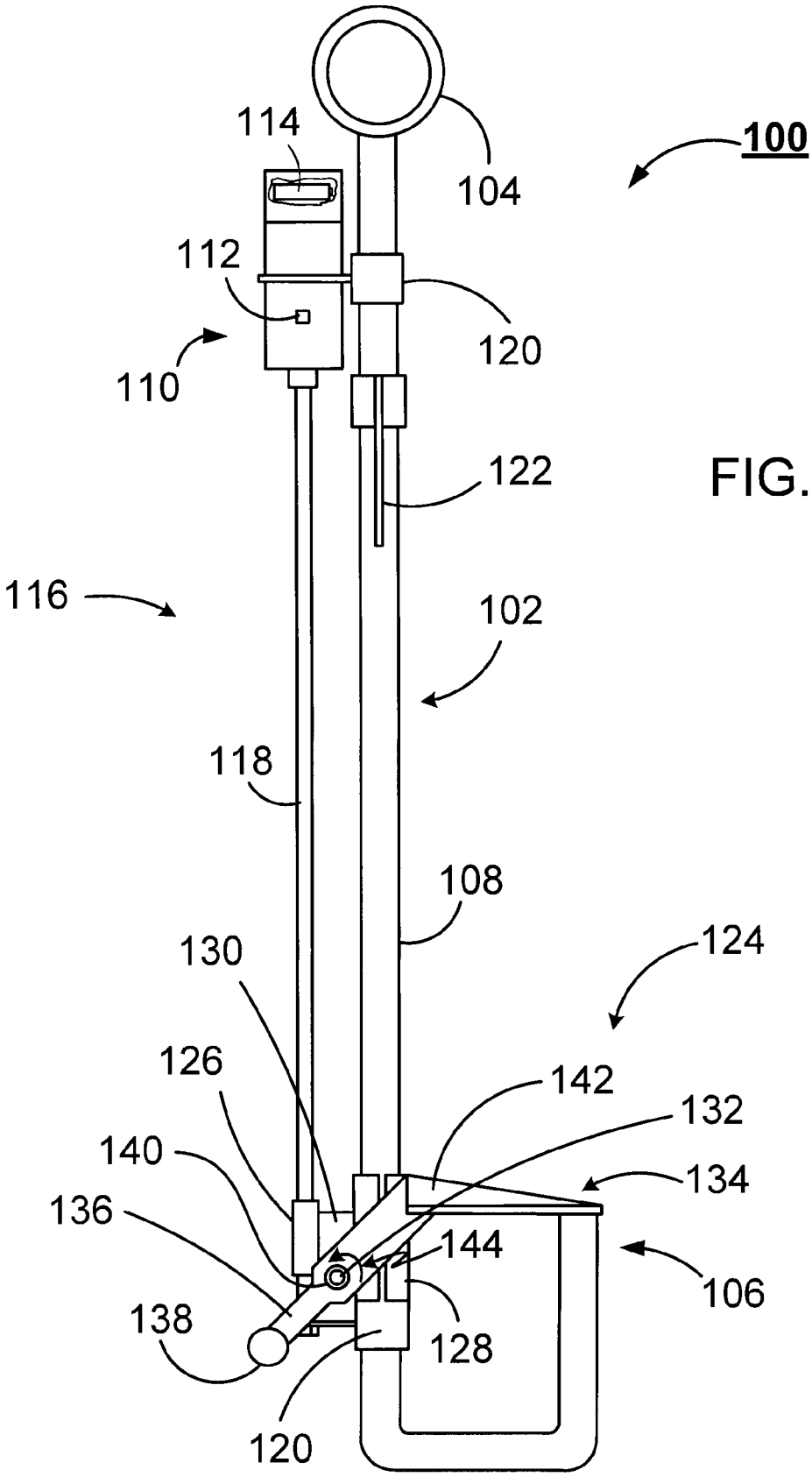
FIG. 1 shows a view in elevation of a remotely operated lift member safety latch combination in a preferred embodiment with a hook lock in a locked position.

Referring to the drawings, FIG. 1 shows a remotely operated lift member safety latch combination 100 (also referred to herein as apparatus 100). The apparatus 100 is displayed with a lift member 102 having an eyelet 104 attached to one end, a retention region 106 provided at an opposite, and a support portion 108 disposed between the eyelet 104 and the retention region 106. In a preferred embodiment, a remotely controlled drive device 110 (also referred to herein as drive device 110) is supported adjacent the eyelet 104 by the support portion 108. Preferably, the drive device 110 is provided with a manual operation switch 112 for various uses including, but not limited to, use in testing the apparatus 100, and to promote operational life of a battery 114 confined within the drive device 110.

The drive device 110 preferably forms a portion of a drive mechanism 116 that includes a confinement member positioning mechanism 118 secured to the support portion 108 and communicating with the drive device 110. Preferably the confinement member positioning mechanism 118 is a worm gear, but may take the form of a cable, chain, or hydraulic actuator without departing from the spirit of the present invention. It should be noted that the mechanism 118 is not limited to moving components and can be various configurations that allow controlled operation.

Further, the drive device 110 is preferably an electric motor in the form of an AC motor or DC motor, but can take the form of a rotary hydraulic or pneumatic motor, a linier hydraulic or pneumatic motor, or a small combustion engine without departing from the spirit of the present invention.

In addition, the drive mechanism 116 is attached to the support portion 108 in multiple locations with brackets 120. However, the use of bracket shown in FIG. 1 is not limiting as the drive mechanism 116 can be connected to the lift member through various mechanical components. In a preferred embodiment, the support portion 108 further accommodates an actuator 122, which interacts with a confinement member 124 to place the confinement member 124 in an open state or a locked state. It should be noted that the two states of the confinement member 124 are merely descriptive of the physical position of the member in relation to the lift member. As such, the confinement member 124 can be in the open state while enclosing the retention region 106.

Figure 2:
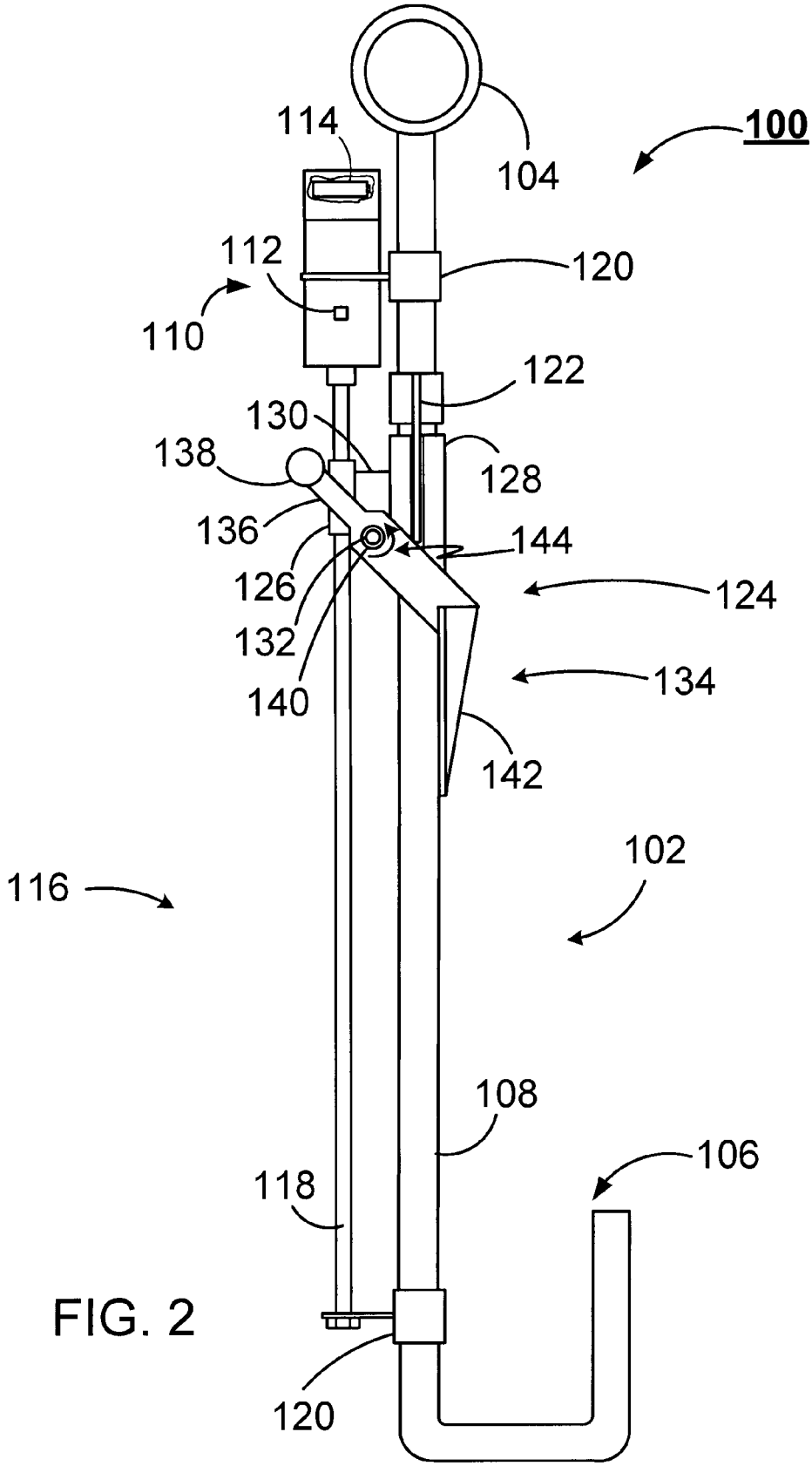
FIG. 2 illustrates a view in elevation of the remotely operated lift member safety latch combination of FIG. 1 with the hook lock in an open position.
Figure 3:
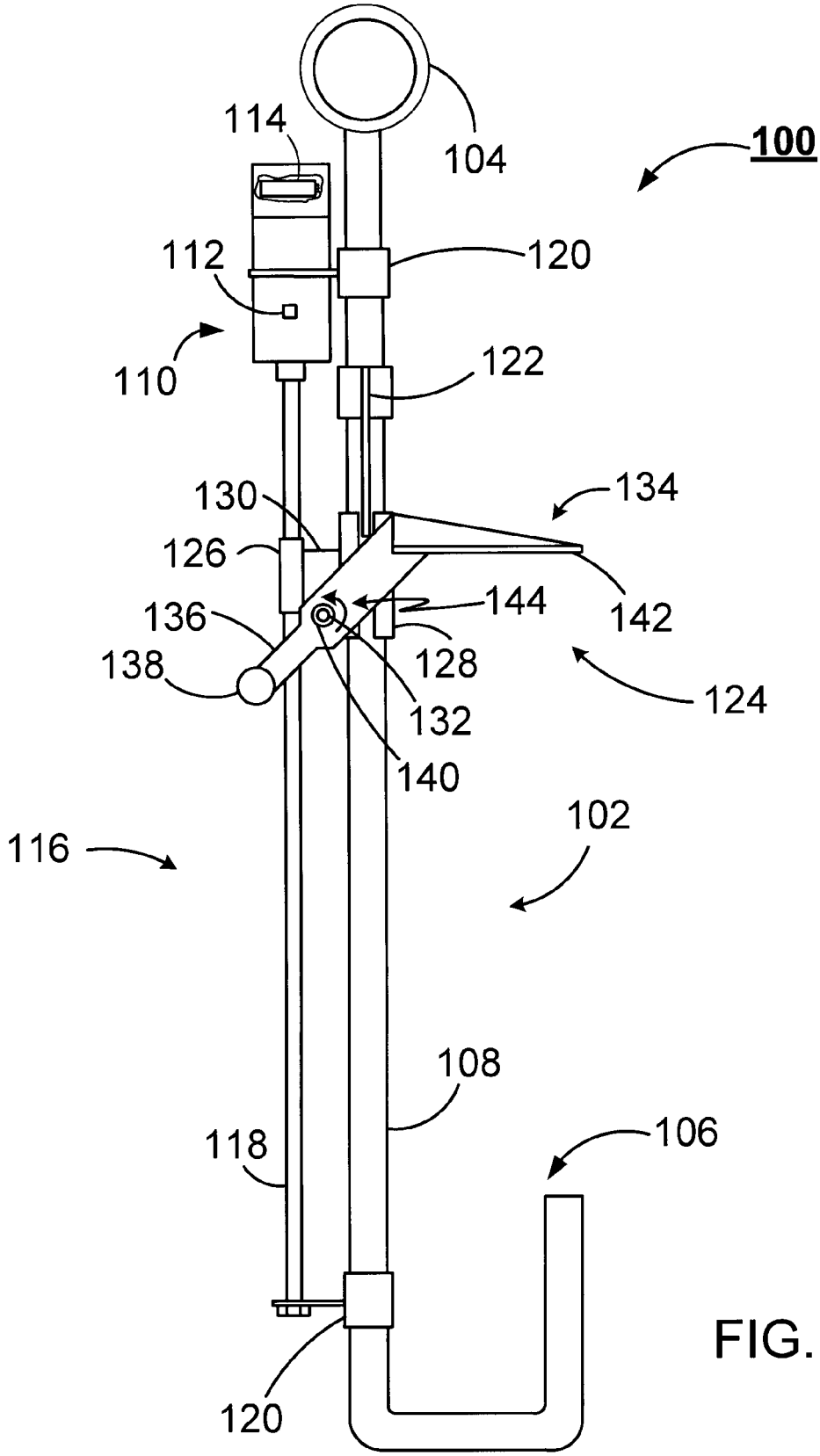
FIG. 3 reveals a view in elevation of the remotely operated lift member safety latch combination of FIG. 1 with the hook lock in locked position prior to engaging a folding actuator.

Furthermore, the confinement member 124 is in a locked state when the member is substantially parallel to the support portion 108 of the lift member 102. In some embodiments, the locked state corresponds to the position of the confinement member 124 disengaged from the actuator 122, as shown by FIGS. 1 and 3, and in an open state when the confinement member 124 is interacting with the actuator 122, as shown by FIG. 2.

In a preferred embodiment, the confinement member 124 includes at least a worm coupling 126 communicating with the confinement member positioning mechanism 118, a slide member 128 interacting with the support portion 108, a support bracket 130 disposed between the worm coupling 126 and the slide member 128, a hinge pin 132 secured to the slide member 128 and coupled to a retention member 134, which is pivotally attached to the support bracket 130. However, the combination displayed in FIGS. 1-5 is not limiting and the various components can be independently changed to accommodate efficient confinement member movement. For example, the slide member 128 can be oriented to float around the support portion 108 of the lift member 102 so that the confinement member 124 is only connected to the drive mechanism during normal operation. Similarly, the support bracket 130 can be various configurations that orient the confinement member 124 to the support portion 108 of the lift member 102.

Likewise, the hinge pin 132 can be placed in a position offset from the major (vertical) axis of the lift member 102. That is, the point of rotation of the confinement member 124 is offset from the support portion 108 of the lift member 102 to ensure the confinement member 124 does not interfere with access to the retention region 106.

Further in a first preferred embodiment, the retention member 134 includes a pivot arm portion 136, which provides a counterweight portion 138 and includes an attachment aperture 140, and a load confinement portion 142 that interacts with retention region 106 to enclose the retention region 106 so that a load could not inadvertently disengage the retention region 106. The counterweight portion 138 preferably imparts a torque force 144 about the hinge pin 132 to maintain the load confinement region 142 in a locked state when the pivot arm portion 136 is disengaged from interaction with the actuator 122.

Figure 4:
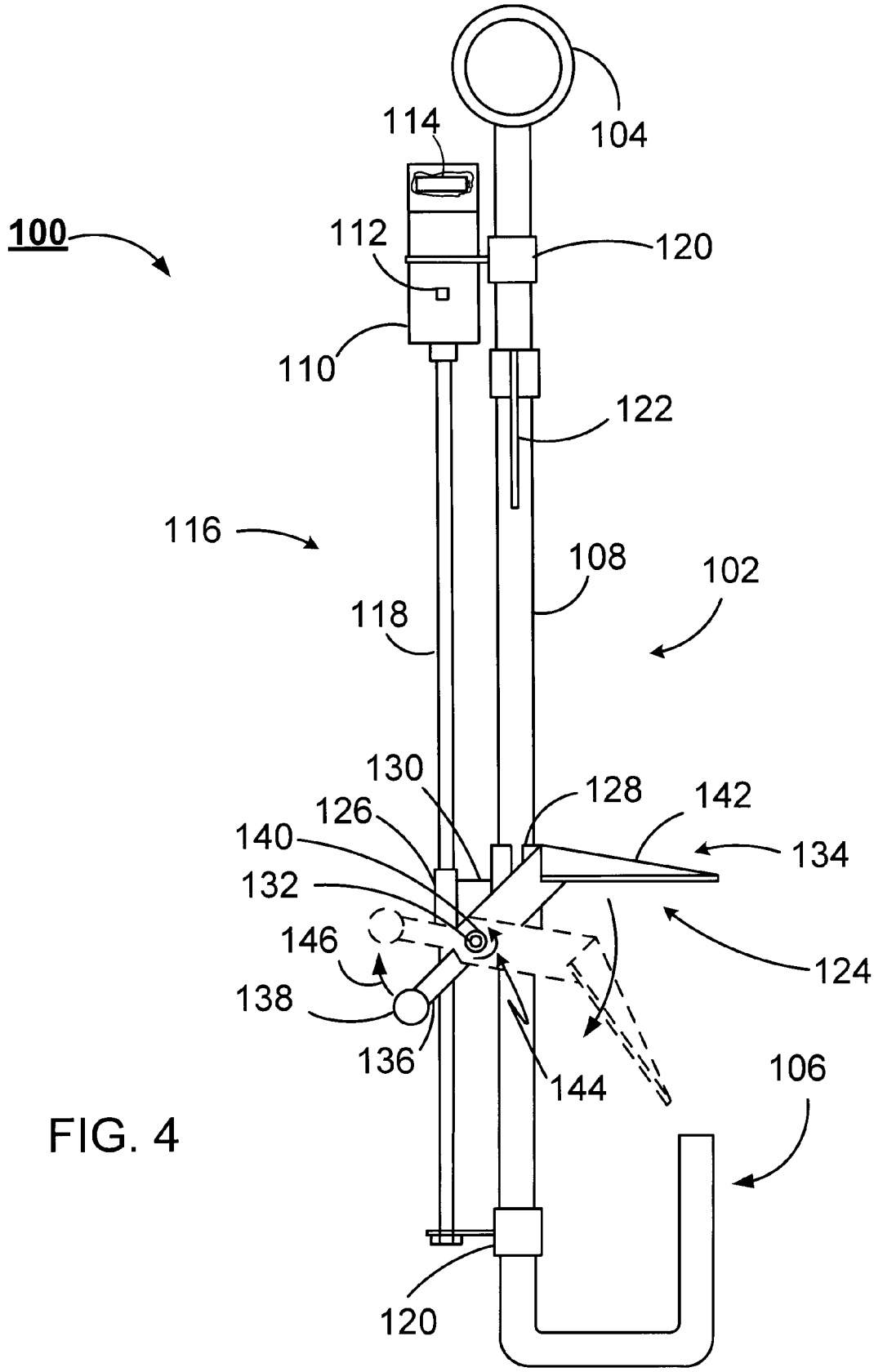
FIG. 4 depicts a view in elevation of the remotely operated lift member safety latch combination of FIG. 1 showing the hook lock, when disengaged from a load region of a lift member of the inventive lift member safety latch combination of FIG. 1.

However, the torque force 144 can be overcome by applying a lift force 146 to the counterweight portion 138, as shown by FIG. 4. The ability to either remotely or manually transition the confinement member 124 from the locked state to the open state, or vise versa, provides advantages in testing and troubleshooting of the combination 100. Preferably, manual operation of the confinement member is conducted by toggling the manual operation switch 112 on the drive device 110 and lifting the counterweight portion 138 of the confinement member 124. In contrast, remote operation of the confinement member 124 preferably has gravity operating to transition the member 124 from the open to locked states and the actuator operating to transition the confinement member 124 from locked to open states.

Figure 5:
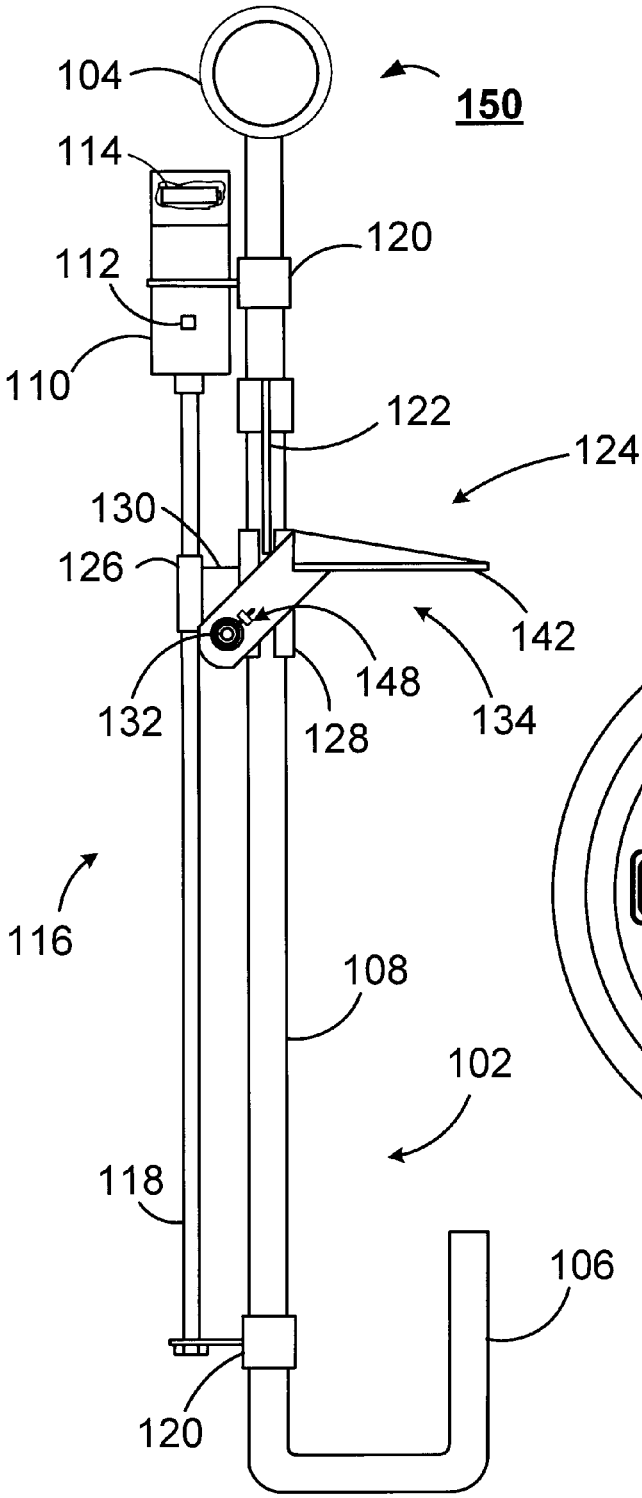
FIG. 5 shows a view in elevation of an alternative embodiment of a remotely operated lift member safety latch combination with a hook lock adjacent a folding aperture and in a locked position.

In an alternative preferred embodiment of a remotely operated lift member safety latch combination 150 shown by FIG. 5, the counterweight portion 138 is not present, but rather a position retention spring 148 disposed between the attachment aperture 140 and the hinge pin 132, and secured to each the pivot arm portion 136 and the support bracket 130 is provided. The position retention spring 148 preferably imparts a torque force 144 about the hinge pin 132 to maintain the load confinement region 142 in a locked state when the pivot arm portion 136 is disengaged from interaction with the folding actuator 122. It should be noted that the manual and remote operation of the confinement member 124 is not materially altered by the inclusion of the position retention spring 148.

Figure 6:
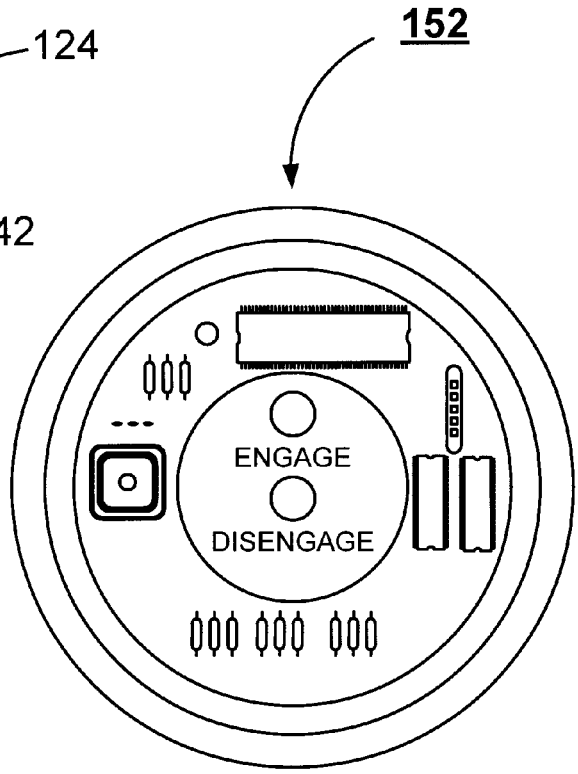
FIG. 6 illustrates a partial cutaway plan view of a remote controller configured for interaction with the remotely operated lift member safety latch combinations of FIG. 1 and FIG. 5.

FIG. 6 is a partial cutaway plan view of a remote controller 152 configured for interaction with either the remotely operated lift member safety latch combinations 100, of FIG. 1, or the remotely operated lift member safety latch combinations 150 of FIG. 5.

Figure 7:
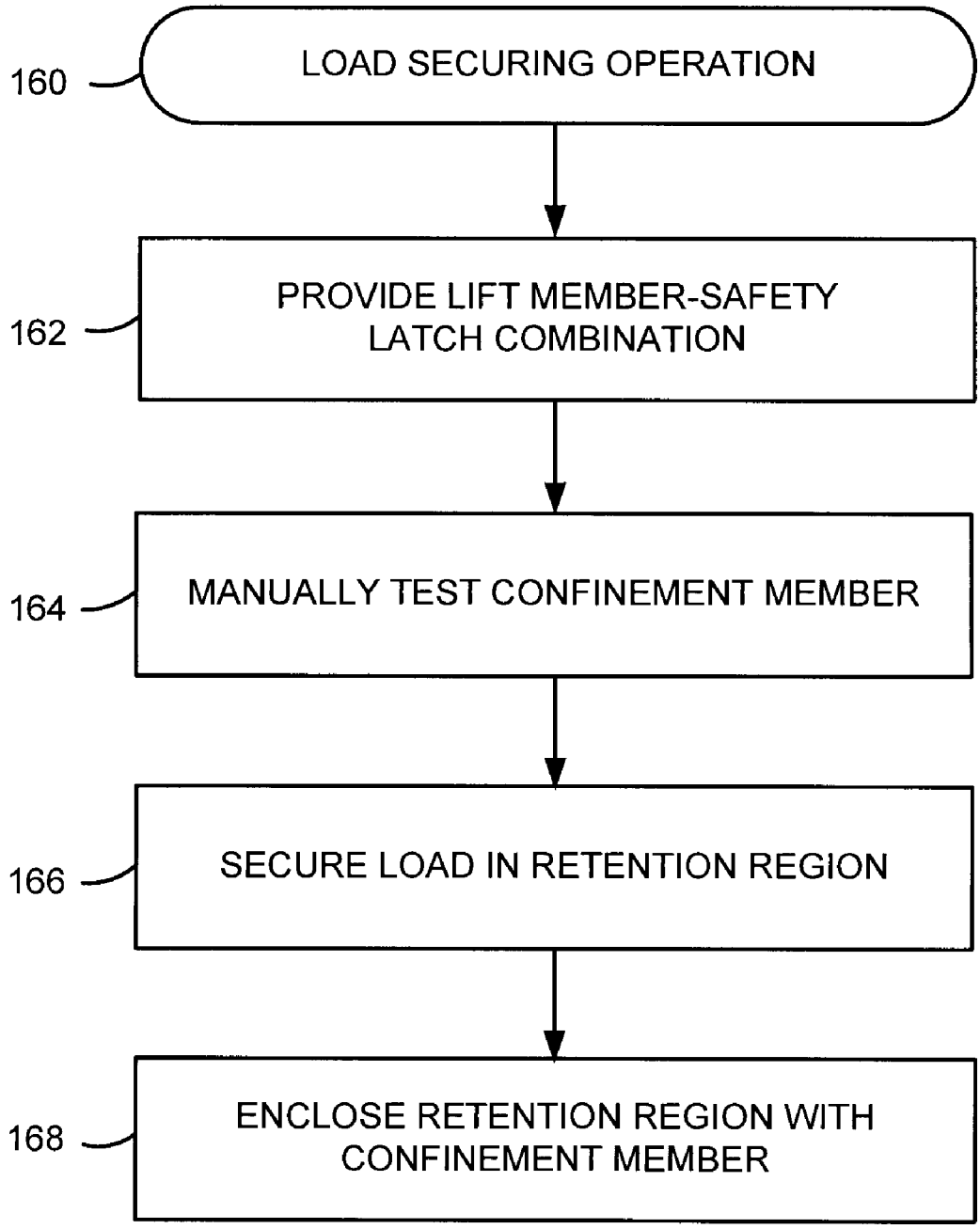
FIG. 7 provides a flow chart representation of a load securing operation performed in accordance with various embodiments of the present invention.

FIG. 7 provides a flow chart representation of a load securing operation 160 performed in accordance with various embodiments of the present invention. In step 162, the lift member-safety latch combination is provided. The combination can comprise various embodiments of the lift member, drive mechanism, and confinement member discussed above without deterring from the spirit of the present invention. The confinement member is tested in step 164 with a manual adjustment of the counterweight portion 138 to ensure proper transition from the locked state to the open state. However, step 164 can be optionally skipped during the load securing operation 160 if testing of the confinement member is not necessary.

In step 166, the retention region of the lift member engages a load so that the lift member has secured control of the load while the lift member is in movement. With the load secured in the retention region, the confinement member is positioned at step 168 adjacent the retention region in the locked state so that the region is enclosed and the load cannot practically disengage the lift member and retention region. Several safety and efficiency advantages become apparent when performing the load securing operation 160 such as the ability to secure a load before hoisting the lift member and the reduced probability that the load will disengage the lift member during hoisting.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

It will be clear that the present invention is well adapted to attain the ends and advantages mentioned as well as those inherent therein. While presently preferred embodiments have been described for purposes of this disclosure, numerous changes may be made which will readily suggest themselves to those skilled in the art and which are encompassed by the appended claims.

What is claimed is:

1. A lift member safety latch combination comprising:

a lift member;

a drive mechanism supported by the lift member;

a actuator positioned adjacent the drive mechanism and supported by the lift member; and a confinement member in sliding communication with the lift member, position responsive to the drive mechanism, and state responsive to the actuator, in which the drive mechanism comprises a hook lock positioning mechanism, the hook lock positioning mechanism comprising:

a worm gear;

a worm coupling communicating with the worm gear;

a slide member interacting with the lift member;

a support bracket disposed between the worm coupling and the slide member;

a hinge pin secured to the slide member; and a retention member pivotally attached to the support bracket via the hinge pin, wherein the retention member is in a locked state when the retention member is disengaged from the folding actuator, and in an open state when the retention member is interacting with the folding actuator.

2. The combination of claim 1, in which the drive mechanism further comprises a drive device communicating with the hook lock positioning mechanism.

3. The combination of claim 2, in which the drive device is an electric motor.

4. The combination of claim 1, in which the retention member comprising:

a pivot arm portion providing an attachment aperture communicating with the hinge pin;

a load confinement portion extending from a first end of the pivot arm portion; and a counterweight attached to a second end of the pivot arm, wherein the mass of the counter weight is greater than the mass of the load confinement portion.

5. The combination of claim 1, in which the retention member comprising:

a pivot arm portion providing an attachment aperture communicating with the hinge pin;

a load confinement portion extending from a first end of the pivot arm portion; and a coil spring disposed between the pivot aperture and the hinge pin, and attached to each the pivot arm and the hinge pin, wherein the coil spring retains the load confinement portion in a locked state when the pivot arm portion is disengaged from interacting with the folding actuator and in an open state when the pivot arm portion is interacting with the folding actuator.

6. The combination of claim 1, in which the actuator transitions the retention member from a locked state to an open state.

7. The combination of claim 1, in which the retention member remotely transitions from an open state to a locked state solely by gravity.

8. The combination of claim 1, in which the drive mechanism is positioned at the proximal end of the lift member while a retention region is located at the distal end of the lift member.

9. The combination of claim 1, in which the drive mechanism is adjacent an eyelet.

10. The combination of claim 1, in which the retention member is remotely engaged in an open position only by the actuator.

11. The combination of claim 1, in which the retention member is positioned in a locked state without enclosing a retention region.

12. The combination of claim 1, in which a pivot arm rotates around an axis that is offset from the major dimension of the lift member.

13. The combination of claim 1, in which the retention member is connected only to the drive mechanism.

14. The combination of claim 1, in which the confinement member is capable of being manually transitioned from a locked state to an open state without engaging the actuator.

15. A method of using a lift member safety latch combination comprising the steps of:

providing a drive mechanism supported by a lift member; and enclosing a retention region of the lift member with a confinement member, in which the drive mechanism comprising a hook lock positioning mechanism, the hook lock positioning mechanism comprising:

a worm gear;

a worm coupling communicating with the worm gear;

a slide member interacting with the lift member;

a support bracket disposed between the worm coupling and the slide member;

a hinge pin secured to the slide member; and a retention member pivotally attached to the support bracket via the hinge pin, wherein the retention member is in a locked state when the retention member is disengaged from the folding actuator, and in an open state when the retention member is interacting with the folding actuator.

16. The method of claim 15, in which the confinement member transitions from an open state to a locked state by gravity alone.

17. The method of claim 15, in which the confinement member is capable of being manually transitioned from a locked state to an open state without engaging the actuator.

18. The method of claim 15, in which the confinement member is in a locked state without enclosing the retention region.

* * * * *